US005257559A

United States Patent [19]

Cannetti

[11] Patent Number: 5,257,559

[45] Date of Patent: Nov. 2, 1993

[54] INTERNAL PIPE GRIPPING DEVICE

[76] Inventor: John Cannetti, 14-18 30th Rd., Astoria, N.Y. 11102

[21] Appl. No.: 893,034

[22] Filed: Jun. 3, 1992

[51] Int. Cl.[5] ..... B25B 13/18

[52] U.S. Cl. ..... 81/445; 81/446

[58] Field of Search ..... 81/442–447, 81/450, 460; 269/48.1, 48.2, 48.3; 279/2.01, 2.03, 2.04, 2.1, 2.11, 2.12, 2.18, 2.24

[56] References Cited

U.S. PATENT DOCUMENTS

| | | | |
|---|---|---|---|
| 1,968,872 | 8/1934 | Campbell | 81/445 |
| 2,811,067 | 10/1957 | Greer | 81/445 |
| 3,902,384 | 9/1975 | Ehrler | 81/445 |

*Primary Examiner*—D. S. Meislin

*Attorney, Agent, or Firm*—Michael I. Kroll

[57] ABSTRACT

An internal pipe gripping device is provided which consists of a mechanism at one end for grasping an inner surface of a pipe and a structure at an opposite end for coupling to a pipe turning machine, so that the pipe can be rotated to be cut, polished, threaded and the like.

7 Claims, 2 Drawing Sheets

INTERNAL PIPE GRIPPING DEVICE

BACKGROUND OF THE INVENTION

1. Field of the Invention

The instant invention relates generally to internal pipe wrenches and more specifically it relates to an internal pipe gripping device.

2. Description of the Prior Art

Numerous internal pipe wrenches have been provided in prior art that are adapted to loosen, tighten and remove broken pipe, closed nipples and other pipe fittings when it's impossible to get an external grip in tight spots where ordinary wrenches are useless. While these units may be suitable for the particular purpose to which they address, they would not be as suitable for the purposes of the present invention as heretofore described.

SUMMARY OF THE INVENTION

A primary object of the present invention is to provide an internal pipe gripping device that will overcome the shortcomings of the prior art devices.

Another object is to provide an internal pipe gripping device with expandable jaws at one end that can be extended against the inner surface of a pipe, so that an opposite end of the device can be coupled to a pipe turning machine.

An additional object is to provide an internal pipe gripping device that will grip the inner surface of the pipe without damaging the pipe, so that when the device is coupled to the pipe turning machine the pipe can be rotated to be cut, polished, threaded and the like.

A further object is to provide an internal pipe gripping device that is simple and easy to use.

A still further object is to provide an internal pipe gripping device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
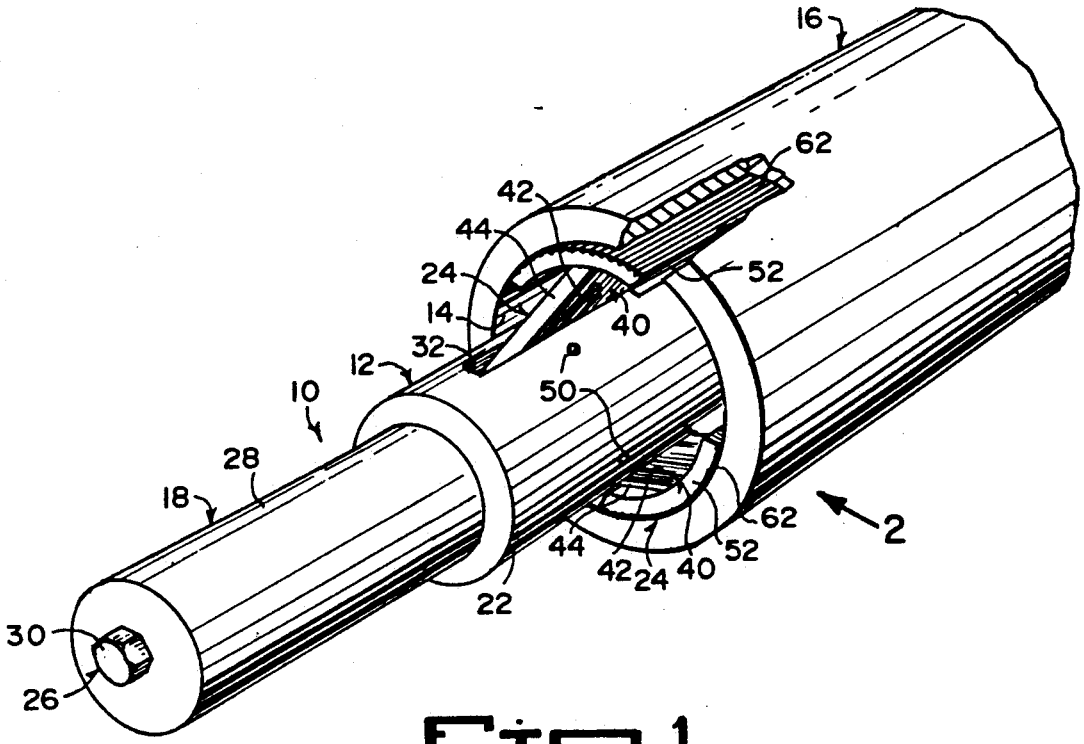
FIG. 1 is a perspective view of a first embodiment of the instant invention coupled to the inner surface of a pipe with part of the pipe broken away.

Turning now descriptively to the drawings, in which similar reference characters denote similar elements throughout the several views, the Figures illustrate an internal pipe gripping device 10 which consists of a mechanism 12 at one end of the device 10 for grasping an inner surface 14 of a pipe 16. A structure 18 is at an opposite end of the device 10, for coupling the device 10 to a pipe turning machine 20, so that the pipe 16 can be rotated to be cut, polished, threaded and the like.

The grasping mechanism 12 includes a cylindrical housing 22 sized to fit into the pipe 16. A plurality of expandable jaw assemblies 24 are radially positioned about the cylindrical housing 22 and an apparatus 28 manually operable for extending the expandable jaw assemblies 24 against the inner surface 14 of the pipe 16.

The coupling structure 18 is an elongated cylindrical shank 28 extending from the cylindrical housing 22 and is sized to fit into a mandrel 29 of the pipe turning machine 20.

Figure 2:
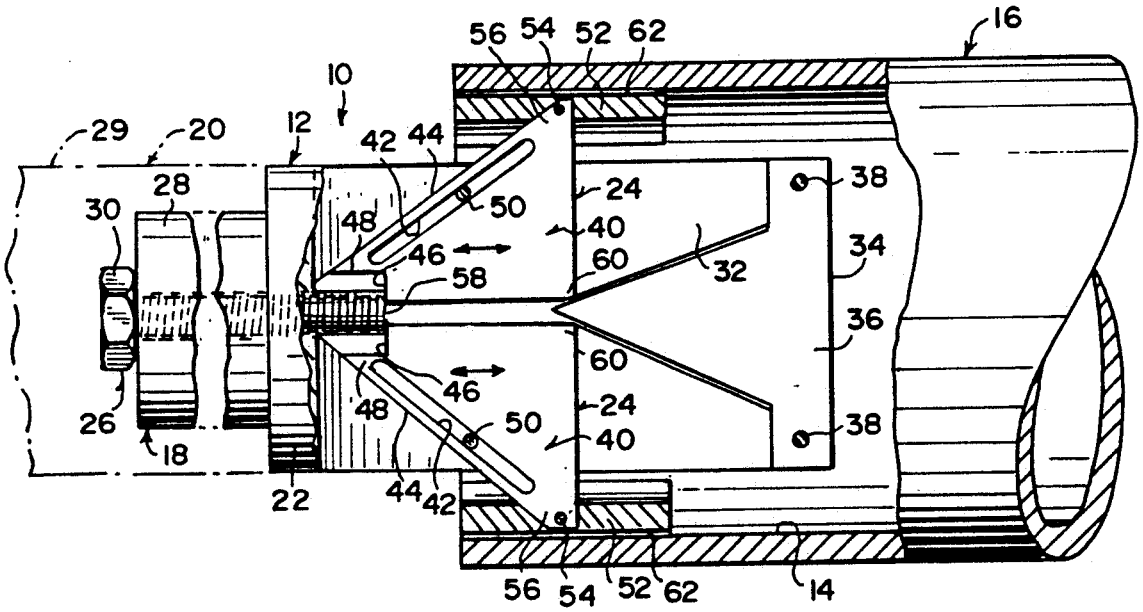
FIG. 2 is an elevational view taken in direction of arrow 2 in FIG. 1, with parts broken away and in section.

As shown in FIGS. 1 and 2, the extending apparatus 26 is an elongated bolt 30 threaded through the elongated cylindrical shank 28 and into the cylindrical housing 22, so as to push the expandable jaw assemblies 24 outwardly through the cylindrical housing 22 to bear against the inner surface 14 of the pipe 16. The grasping mechanism 12 further includes the cylindrical housing 22 having a channel 32 extending inwardly from a first end 34. A stationary wedge-shaped member 36 is mounted in the channel 32 at the first end 34 of the cylindrical housing 22. Each expandable jaw assembly 24 can ride upon the stationary wedge-shaped member 36 when the elongated bolt 30 is turned. A plurality of fasteners 38 are provided with each extending through the cylindrical housing 22 and the stationary wedge-shaped member 36 in the channel 32.

Each expandable jaw assembly 24 includes a right triangular-shaped arm 40 having a slot 42 along its angular edge 44 and a seat 46 formed at a first corner 48 adjacent the slot 42. A stationary guide rod 50 extends through the channel 32 in the cylindrical housing 22 and the slot 42 in the arm 40. A curved plate 52 is provided with a pin 54 extending through a second corner 56 of the arm 40 adjacent the slot 42 and into the curved plate 52. When the elongated bolt 30 is turned its distal end 58 will push against the seat 46 moving a right angle corner 60 on the arm 40 along the stationary wedge-shaped member 36, while the slot 42 in the arm 40 will rude upon the guide rod 50, thereby causing the curved plate 52 to move away from the cylindrical housing 22 and engage with the inner surface 14 of the pipe 12. The curved plate 52 has an external knurled surface 62, so that the external knurled surface 62 can better engage with the inner surface 14 of the pipe 16 to prevent slippage therefrom.

Figure 3:
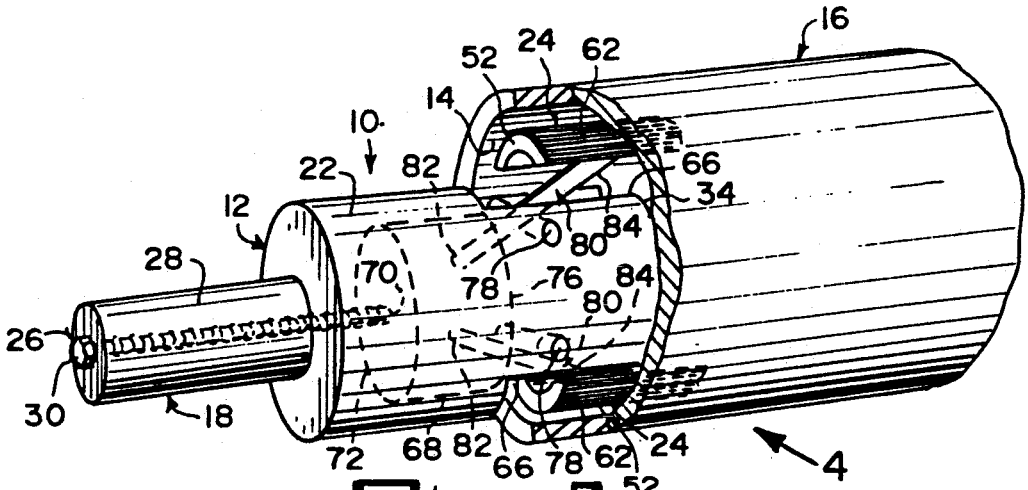
FIG. 3 is a perspective view of a second embodiment of the instant invention coupled to the inner surface of a pipe with part of the pipe broken away.
Figure 4:
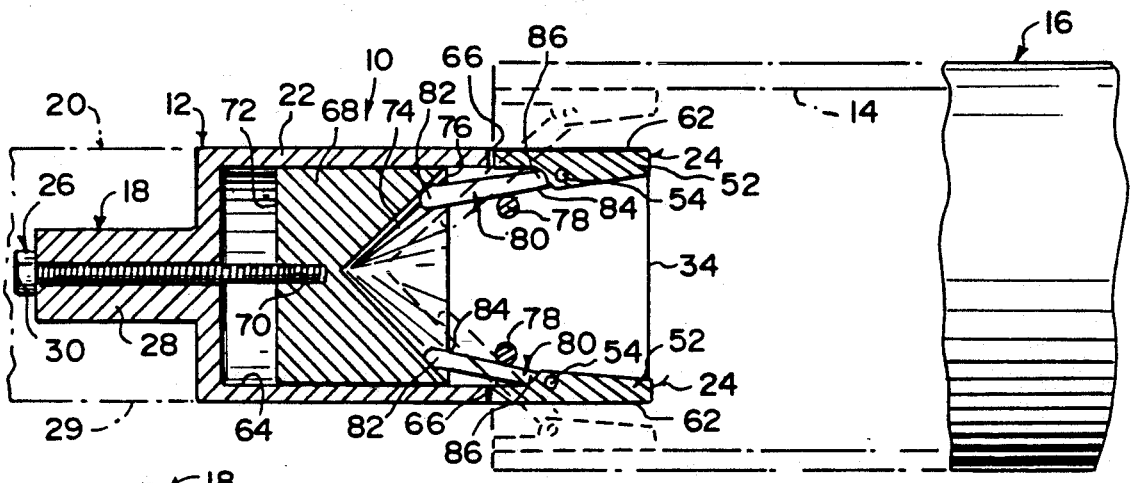
FIG. 4 is an elevational view taken in direction of arrow 4 in FIG. 3 with parts broken away and in section.
Figure 5:
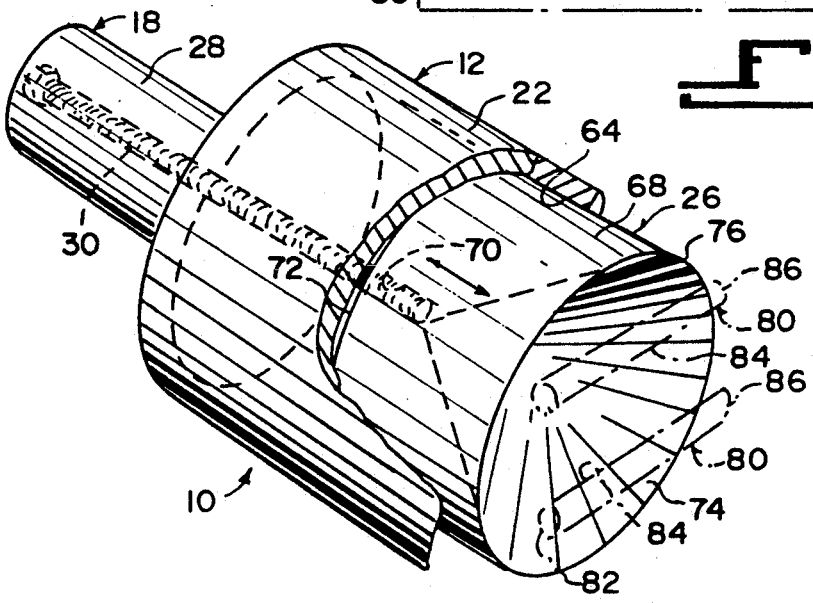
FIG. 5 is a rear perspective view of the second embodiment per se with parts broken away.

As shown in FIGS. 3, 4 and 5, the extending apparatus 26 consists of the cylindrical housing 22 having a cylindrical bore and a plurality of slots 66 extending inwardly from a first end 34. An elongated bolt 30 is threaded through the elongated cylindrical shank 28 and into the cylindrical bore 64 in the cylindrical housing 22. A cylindrical slideable member 68 is provided having a threaded hole 70 in a first end 72 and a cone-shaped depression 74 in a second end 76. The cylindrical slideable member 68 can fit into the cylindrical bore 64 in the cylindrical housing 22 with a distal end 58 of the elongated bolt 30 threadable into the threaded hole 70, while the cone-shaped depression 74 can push the expandable jaw assemblies 24 outwardly through the slots 66 in the cylindrical housing 22 to bear against the inner surface 14 of the pipe 16.

Each expandable jaw assembly 24 contains a stationary guide shaft 78 extending through the cylindrical bore 64 below one of the slots 66 in the cylindrical housing 22. An arm 80 has a first end 82 to bear against the cone-shaped depression in the cylindrical slideable member 68 and a side 84 to rest upon the stationary guide shaft 78. A curved plate 52 is provided with a pin 54 extending through the second end 86 of the arm 80 and into the curved plate 52. When the elongated bolt 30 is turned the cylindrical slideable member 68 will push against the first end 82 of the arm 80 moving the side 84 of the arm 80 along the stationary guide shaft 78, thereby causing the curved plate 52 to move away from the cylindrical housing 22 and engage with the inner surface 14 of the pipe 16. The curved plate 52 also has an external knurled surface 62, so that the external knurled surface 62 can better engage with the inner surface 14 of the pipe 16 to prevent slippage therefrom.

LIST OF REFERENCE NUMBERS

10 internal pipe gripping device
12 grasping mechanism
14 inner surface of 16
16 pipe
18 coupling structure
20 pipe turning machine
22 cylindrical housing;
24 expandable jaw assembly
26 manually operable extending apparatus
28 elongated cylindrical shank for 18
29 mandrel of 20
30 elongated bolt for 26
32 channel in 22
34 first end of 22
36 stationary wedge-shaped member
38 fastener
40 right triangular-shaped arm
42 slot in 40
44 angular edge of 40
46 seat at 48
48 first corner of 40
50 stationary guide rod
52 curved plate
54 pin
56 second corner of 40
58 distal end of 30
60 right angle corner of 40
62 external knurled surface on 52
64 cylindrical bore in 22
66 slot in 22
68 cylindrical slideable member
70 threaded hole in 72
72 first end of 68
74 cone-shaped depression in 76
76 second end of 68
78 stationary guide shaft
80 arm
82 first end of 80
84 side of 80
86 second end of 80

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the ar without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An internal pipe gripping device which comprises:

a) means at one end of said device for grasping an inner surface of a pipe;

b) means at an opposite end of said device, for coupling said device to a pipe turning machine, so that the pipe can be rotated to be cut, polished, threaded and the like, c) wherein said grasping means includes a cylindrical housing sized to fit into the pipe, a plurality of expandable jaw assemblies radially positioned about said cylindrical housing, and means manually operable for extending said expandable jaw assemblies against the inner surface of the pipe;

d) wherein said coupling means includes an elongated cylindrical shank extending from said cylindrical housing and sized to fit into a mandrel of the pipe turning machine;

e) wherein said extending means includes an elongated bolt threaded through said elongated cylindrical shank and into said cylindrical housing, so as to push said expandable jaw assemblies outwardly through said cylindrical housing to bear against the inner surface of the pipe; and f) wherein said grasping means further includes said cylindrical housing having a channel extending inwardly from a first end, a stationary wedge-shaped member, and means for mounting said stationary wedge-shaped member in the channel at the first side of said cylindrical housing, so that each said expandable jaw assembly can ride upon said stationary wedge-shaped member when said elongated bolt is turned.

2. An internal pipe gripping device as recited in claim 1, wherein said mounting means are a plurality of fasteners, each extending through said cylindrical housing and said stationary wedge-shaped member in the channel.

3. An internal pipe gripping device as recited in claim 2, wherein each said expandable jaw assembly includes:

a) a right triangular-shaped arm having a slot along its angular edge and a seat formed at a first corner adjacent the slot;

b) stationary guide rod extending through the channel in said cylindrical housing and the slot in said arm;

c) a curved plate; and d) a pin extending through a second corner of said arm adjacent the slot and into said curved plate, so that when said elongated bolt is turned its distal end will push against the seat, moving a right angle corner on said arm along said stationary wedge-shaped member, while the slot in said arm will ride upon said guide rod, thereby causing said curved plate to move away from said cylindrical housing and engage with the inner surface of the pipe.

4. An internal pipe gripping device as recited in claim 3, wherein said curved plate includes an external knurled surface, so that said external knurled surface can better engage with the inner surface of the pipe to prevent slippage therefrom.

5. An internal pipe gripping device which comprises:

a) means at one end of said device for grasping an inner surface of a pipe;

b) means at an opposite end of said device, for coupling said device to a pipe turning machine, so that the pipe can be rotated to be cut, polished, threaded and the like;

c) wherein said grasping means includes a cylindrical housing sized to fit into the pipe, a plurality of expandable jaw assemblies radially positioned about said cylindrical housing, and means manually operable for extending said expandable jaw assemblies against the inner surface of the pipe;

d) wherein said coupling means includes an elongated cylindrical shank extending from said cylindrical housing and sized to fit into a mandrel of the pipe turning machine.

e) said cylindrical housing having a cylindrical bore and a plurality of slots extending inwardly from a first end;

f) an elongated bolt threaded through said elongated cylindrical shank and into the cylindrical bore in said cylindrical housing; and g) a cylindrical slideable member having a threaded hole in a first end and a cone-shaped depression in a second end, whereby said cylindrical slideable member can fit into the cylindrical bore in said cylindrical housing with a distal end of said elongated bolt threadable into the threaded hole, while the cone-shaped depression can push said expandable jaw assemblies outwardly through the slots in said cylindrical housing to bear against the inner surface of the pipe.

6. An internal pipe griping device as recited in claim 5, wherein each said expandable jaw assembly includes:

a) a stationary guide shaft extending through the cylindrical bore below one of the slots in said cylindrical housing;

b) an arm having a first end to bear against the cone-shaped depression in said cylindrical slideable member and a side to rest upon said stationary guide shaft;

c) a curved plate; and d) a pin extending through a second end of said arm and into said curved plate, so that when said elongated bolt is turned said cylindrical slideable member will push against the first end of said arm moving the side of said arm along said stationary guide shaft, thereby causing said curved plate to move away from said cylindrical housing and engage with the inner surface of the pipe.

7. An internal pipe gripping device as recited in claim 6, wherein said curved plate includes an external knurled surface, so that said external knurled surface can better engage with the inner surface of the pipe to prevent slippage therefrom.

* * * * *